US010163448B2

(12) United States Patent
Naka et al.

(10) Patent No.: US 10,163,448 B2
(45) Date of Patent: Dec. 25, 2018

(54) LINEAR PREDICTION COEFFICIENT CONVERSION DEVICE AND LINEAR PREDICTION COEFFICIENT CONVERSION METHOD

(71) Applicant: NTT DOCOMO, INC., Chiyoda-ku, Tokyo (JP)

(72) Inventors: Nobuhiko Naka, Tokyo (JP); Vesa Ruoppila, Nuremberg (DE)

(73) Assignee: NTT DOCOMO, INC., Tokyo (JP)

( * ) Notice: Subject to any disclaimer, the term of this patent is extended or adjusted under 35 U.S.C. 154(b) by 0 days.

(21) Appl. No.: 15/306,292

(22) PCT Filed: Apr. 16, 2015

(86) PCT No.: PCT/JP2015/061763
§ 371 (c)(1),
(2) Date: Oct. 24, 2016

(87) PCT Pub. No.: WO2015/163240
PCT Pub. Date: Oct. 29, 2015

(65) Prior Publication Data

US 2017/0053655 A1 Feb. 23, 2017

(30) Foreign Application Priority Data

Apr. 25, 2014 (JP) ..... 2014-090781

(51) Int. Cl.
*G10L 19/06* (2013.01)
*G10L 19/12* (2013.01)
*G10L 25/12* (2013.01)

(52) U.S. Cl.
CPC ..... *G10L 19/06* (2013.01); *G10L 19/12* (2013.01); *G10L 25/12* (2013.01)

(58) Field of Classification Search
CPC ..... G10L 19/06; G10L 19/12
See application file for complete search history.

(56) References Cited

U.S. PATENT DOCUMENTS 6,253,172 B1 * 6/2001 Ding ..... G10L 19/06 704/219
7,454,330 B1 * 11/2008 Nishiguchi ..... G10L 19/02 704/224

(Continued)

FOREIGN PATENT DOCUMENTS

EP 1 785 985 B1 8/2008
KR 10-2005-0113744 12/2005

(Continued)

OTHER PUBLICATIONS

McLoughlin, I. V. (2008). Line spectral pairs. Signal processing, 88(3), 448-467.*

(Continued)

*Primary Examiner* — Paras D Shah
*Assistant Examiner* — Bryan S Blankenagel
(74) *Attorney, Agent, or Firm* — Brinks Gilson & Lione

(57) ABSTRACT

The purpose of the present invention is to estimate, with a small amount of computation, a linear prediction synthesis filter after conversion of an internal sampling frequency. A linear prediction coefficient conversion device is a device that converts first linear prediction coefficients calculated at a first sampling frequency to second linear prediction coefficients at a second sampling frequency different from the first sampling frequency, which includes a means for calculating, on the real axis of the unit circle, a power spectrum corresponding to the second linear prediction coefficients at the second sampling frequency based on the first linear prediction coefficients or an equivalent parameter, a means for calculating, on the real axis of the unit circle, autocorrelation coefficients from the power spectrum, and a means for converting the autocorrelation coefficients to the second linear prediction coefficients at the second sampling frequency.

13 Claims, 6 Drawing Sheets

(56) References Cited

U.S. PATENT DOCUMENTS

| | | | | |
|---|---|---|---|---|
| 8,024,181 | B2 * | 9/2011 | Ehara | G10L 19/24 704/217 |
| 9,800,453 | B2 * | 10/2017 | Taleb | H04L 29/0651 |
| 2002/0032562 | A1 * | 3/2002 | Van Den Enden | G10L 25/48 704/205 |
| 2003/0177004 | A1 * | 9/2003 | Jabri | G10L 19/12 704/219 |
| 2004/0002856 | A1 * | 1/2004 | Bhaskar | G10L 19/097 704/219 |
| 2005/0075867 | A1 * | 4/2005 | Ansorge | G10L 19/12 704/219 |
| 2006/0149532 | A1 * | 7/2006 | Boillot | G10L 19/26 704/203 |
| 2007/0271092 | A1 | 11/2007 | Ehara et al. | |
| 2013/0322655 | A1 * | 12/2013 | Schuldt | G10L 21/02 381/119 |
| 2014/0012571 | A1 * | 1/2014 | Taleb | G10L 25/06 704/219 |
| 2014/0330415 | A1 * | 11/2014 | Ramo | G10L 19/06 700/94 |

FOREIGN PATENT DOCUMENTS

| | | | | |
|---|---|---|---|---|
| KR | 20050113744 A | * | 12/2005 | G10L 19/06 |
| KR | 10-2007-0051878 | | 5/2007 | |
| WO | WO 2006/028010 A1 | | 3/2006 | |
| WO | WO 2013/068634 A1 | | 5/2013 | |

OTHER PUBLICATIONS

Office Action in corresponding Philippine Application No. 1-2016-502076, dated Feb. 15, 2017, 4 pages.

Extended Search Report in corresponding European Application No. 15783059.7, dated Feb. 28, 2017, 8 pages.

Ian Vince McLoughlin, "Line Spectral Pairs", *Signal Processing*, vol. 88, No. 3, 2008, pp. 448-467.

Office Action, and English language translation thereof, in corresponding Korean Application No. 10-2016-7029288, dated Feb. 27, 2017, 8 pages.

Office Action in corresponding Canadian Application No. 2,946,824, dated Mar. 16, 2017, 6 pages.

Office Action in corresponding Australian Application No. 2015251609, dated May 22, 2017, 2 pages.

"Recommendation ITU-T G.718, Frame Error Robust Narrow-Band and Wideband Embedded Variable Bit-Rate Coding of Speech and Audio From 8-32 kbits/s", *ITU-T*, Jun. 2008, 257 pages.

Cox, R.V., "Speech Coding Standards", *Speech Coding and Synthesis,Elsevier Science*, Edited by W.B. Kleijn, et. al., 1995, pp. 49-78.

English language translation of the Written Opinion of the International Search Authority in corresponding International Application No. PCT/JP2015/061763, dated Jun. 30, 2015, 4 pages.

English language translation of the International Preliminary Report on Patentability in corresponding International Application No. PCT/JP2015/061763, dated Nov. 3, 2016, 7 pages.

Australian Office Action, dated Jan. 5, 2018, pp. 1-3, issued in Australian Patent Application No. 2015251609.

Office Action, and English language translation thereof, in corresponding Korean Application No. 10-2017-7023413, dated Sep. 19, 2017, 11 pages.

Canadian Office Action dated Sep. 11, 2017, pp. 1-4, Canadian Patent Application No. 2,946,824, Canadian Intellectual Property Office, Gatineau (Quebec), Canada.

European Office Action dated Sep. 28, 2017, pp. 1-4, European Patent Application No. 15 783 059.7, European Patent Office, Rijswijk, Netherlands.

Canadian Office Action, dated Apr. 4, 2018, pp. 1-4, issued in Canadian Patent Application No. 2,946,824, Canadian Intellectual Property Office, Gatineau, Quebec, Canada.

* cited by examiner

LINEAR PREDICTION COEFFICIENT CONVERSION DEVICE AND LINEAR PREDICTION COEFFICIENT CONVERSION METHOD

This application is a 371 application of PCT/JP2015/061763 having an international filing date of Apr. 16, 2015, which claims priority to JP2014-090781 filed Apr. 25, 2014, the entire contents of which are incorporated herein by reference.

TECHNICAL FIELD

The present invention relates to a linear prediction coefficient conversion device and a linear prediction coefficient conversion method.

BACKGROUND ART

An autoregressive all-pole model is a method that is often used for modeling of a short-term spectral envelope in speech and audio coding, where an input signal is acquired for a certain collective unit or a frame with a specified length, a parameter of the model is encoded and transmitted to a decoder together with another parameter as transmission information. The autoregressive all-pole model is generally estimated by linear prediction and represented as a linear prediction synthesis filter.

One of the latest typical speech and audio coding techniques is ITU-T Recommendation G.718. The Recommendation describes a typical frame structure for coding using a linear prediction synthesis filter, and an estimation method, a coding method, an interpolation method, and a use method of a linear prediction synthesis filter in detail. Further, speech and audio coding on the basis of linear prediction is also described in detail in Patent Literature 2.

In speech and audio coding that can handle various input/output sampling frequencies and operate at a wide range of bit rate, which vary from frame to frame, it is generally required to change the internal sampling frequency of an encoder. Because the same operation is required also in a decoder, decoding is performed at the same internal sampling frequency as in the encoder. FIG. 1 shows an example where the internal sampling frequency changes. In this example, the internal sampling frequency is 16,000 Hz in a frame i, and it is 12,800 Hz in the previous frame i−1. The linear prediction synthesis filter that represents the characteristics of an input signal in the previous frame i−1 needs to be estimated again after re-sampling the input signal at the changed internal sampling frequency of 16,000 Hz, or converted to the one corresponding to the changed internal sampling frequency of 16,000 Hz. The reason that the linear prediction synthesis filter needs to be calculated at a changed internal sampling frequency is to obtain the correct internal state of the linear prediction synthesis filter for the current input signal and to perform interpolation in order to obtain a model that is temporarily smoother.

One method for obtaining another linear prediction synthesis filter on the basis of the characteristics of a certain linear prediction synthesis filter is to calculate a linear prediction synthesis filter after conversion from a desired frequency response after conversion in a frequency domain as shown in FIG. 2. In this example, LSF coefficients are input as a parameter representing the linear prediction synthesis filter. It may be LSP coefficients, ISF coefficients, ISP coefficients or reflection coefficients, which are generally known as parameters equivalent to linear prediction coefficients. First, linear prediction coefficients are calculated in order to obtain a power spectrum Y(ω) of the linear prediction synthesis filter at the first internal sampling frequency (001). This step can be omitted when the linear prediction coefficients are known. Next, the power spectrum Y(ω) of the linear prediction synthesis filter, which is determined by the obtained linear prediction coefficients, is calculated (002). Then, the obtained power spectrum is modified to a desired power spectrum Y'(ω) (003). Autocorrelation coefficients are calculated from the modified power spectrum (004). Linear prediction coefficients are calculated from the autocorrelation coefficients (005). The relationship between the autocorrelation coefficients and the linear prediction coefficients is known as the Yule-Walker equation, and the Levinson-Durbin algorithm is well known as a solution of that equation.

This algorithm is effective in conversion of a sampling frequency of the above-described linear prediction synthesis filter. This is because, although a signal that is temporally ahead of a signal in a frame to be encoded, which is called a look-ahead signal, is generally used in linear prediction analysis, the look-ahead signal cannot be used when performing linear prediction analysis again in a decoder.

As described above, in speech and audio coding with two different internal sampling frequencies, it is preferred to use a power spectrum in order to convert the internal sampling frequency of a known linear prediction synthesis filter. However, because calculation of a power spectrum is complex computation, there is a problem that the amount of computation is large.

CITATION LIST

Non Patent Literature

Non Patent Literature 1: ITU-T Recommendation G.718

Non Patent Literature 2: Speech coding and synthesis, W. B. Kleijn, K. K. Pariwal, et al. ELSEVIER.

SUMMARY OF INVENTION

Technical Problem

As described above, there is a problem that, in a coding scheme that has a linear prediction synthesis filter with two different internal sampling frequencies, a large amount of computation is required to convert the linear prediction synthesis filter at a certain internal sampling frequency into the one at a desired internal sampling frequency.

Solution to Problem

To solve the above problem, a linear prediction coefficient conversion device according to one aspect of the present invention is a device that converts first linear prediction coefficients calculated at a first sampling frequency to second linear prediction coefficients at a second sampling frequency different from the first sampling frequency, which includes a means for calculating, on the real axis of the unit circle, a power spectrum corresponding to the second linear prediction coefficients at the second sampling frequency based on the first linear prediction coefficients or an equivalent parameter, a means for calculating, on the real axis of the unit circle, autocorrelation coefficients from the power spectrum, and a means for converting the autocorrelation coefficients to the second linear prediction coefficients at the second sampling frequency. In this configuration, it is possible to effectively reduce the amount of computation.

Further, in the linear prediction coefficient conversion device according to one aspect of the present invention, the power spectrum corresponding to the second linear prediction coefficients may be obtained by calculating a power spectrum using the first linear prediction coefficients at points on the real axis corresponding to N1 number of different frequencies, where N1=1+(F1/F2)(N2−1), when the first sampling frequency is F1 and the second sampling frequency is F2 (where F1<F2), and extrapolating the power spectrum calculated using the first linear prediction coefficients for (N2−N1) number of power spectrum components. In this configuration, it is possible to effectively reduce the amount of computation when the second sampling frequency is higher than the first sampling frequency.

Further, in the linear prediction coefficient conversion device according to one aspect of the present invention, the power spectrum corresponding to the second linear prediction coefficients may be obtained by calculating a power spectrum using the first linear prediction coefficients at points on the real axis corresponding to N1 number of different frequencies, where N1=1+(F1/F2)(N2−1), when the first sampling frequency is F1 and the second sampling frequency is F2 (where F1<F2). In this configuration, it is possible to effectively reduce the amount of computation when the second sampling frequency is lower than the first sampling frequency.

One aspect of the present invention can be described as an invention of a device as mentioned above and, in addition, may also be described as an invention of a method as follows. They fall under different categories but are substantially the same invention and achieve similar operation and effects.

Specifically, a linear prediction coefficient conversion method according to one aspect of the present invention is a linear prediction coefficient conversion method performed by a device that converts first linear prediction coefficients calculated at a first sampling frequency to second linear prediction coefficients at a second sampling frequency different from the first sampling frequency, the method including a step of calculating, on the real axis of the unit circle, a power spectrum corresponding to the second linear prediction coefficients at the second sampling frequency based on the first linear prediction coefficients or an equivalent parameter, a step of calculating, on the real axis of the unit circle, autocorrelation coefficients from the power spectrum and a step of converting the autocorrelation coefficients to the second linear prediction coefficients at the second sampling frequency.

Further, a linear prediction coefficient conversion method according to one aspect of the present invention may obtain the power spectrum corresponding to the second linear prediction coefficients by calculating a power spectrum using the first linear prediction coefficients at points on the real axis corresponding to N1 number of different frequencies, where N1=1+(F1/F2)(N2−1), when the first sampling frequency is F1 and the second sampling frequency is F2 (where F1<F2), and extrapolating the power spectrum calculated using the first linear prediction coefficients for (N2−N1) number of power spectrum components.

Further, a linear prediction coefficient conversion method according to one aspect of the present invention may obtain the power spectrum corresponding to the second linear prediction coefficients by calculating a power spectrum using the first linear prediction coefficients at points on the real axis corresponding to N1 number of different frequencies, where N1=1+(F1/F2)(N2−1), when the first sampling frequency is F1 and the second sampling frequency is F2 (where F1<F2).

Advantageous Effects of Invention

It is possible to estimate a linear prediction synthesis filter after conversion of an internal sampling frequency with a smaller amount of computation than the existing means.

DETAILED DESCRIPTION OF THE PREFERRED EMBODIMENTS

Figure 1:
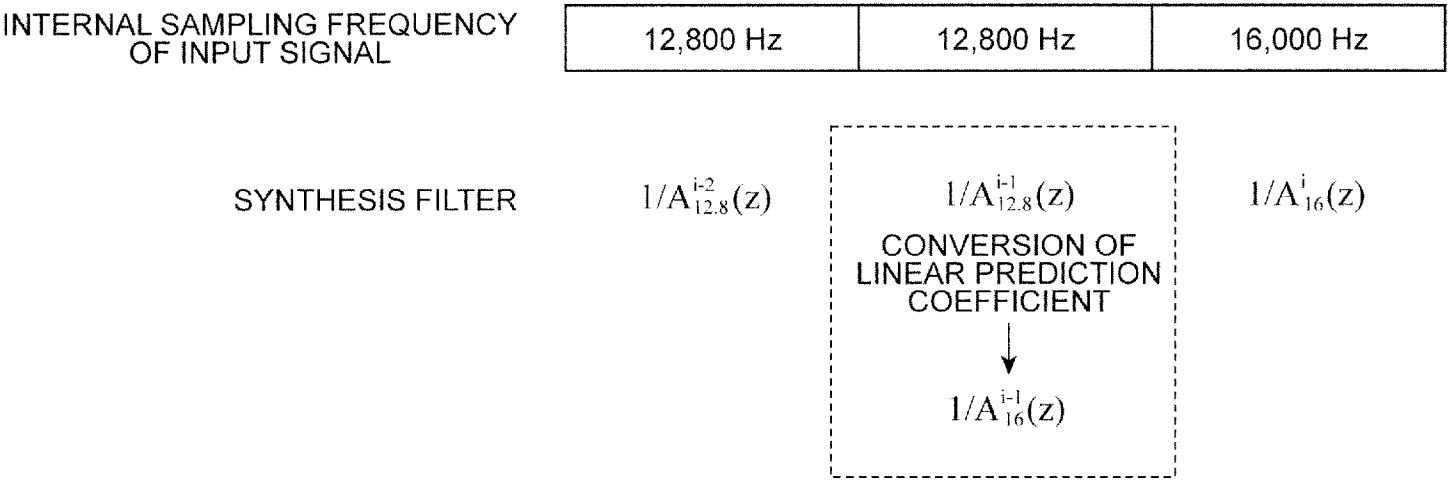
FIG. 1 is a view showing the relationship between switching of an internal sampling frequency and a linear prediction synthesis filter.
Figure 2:
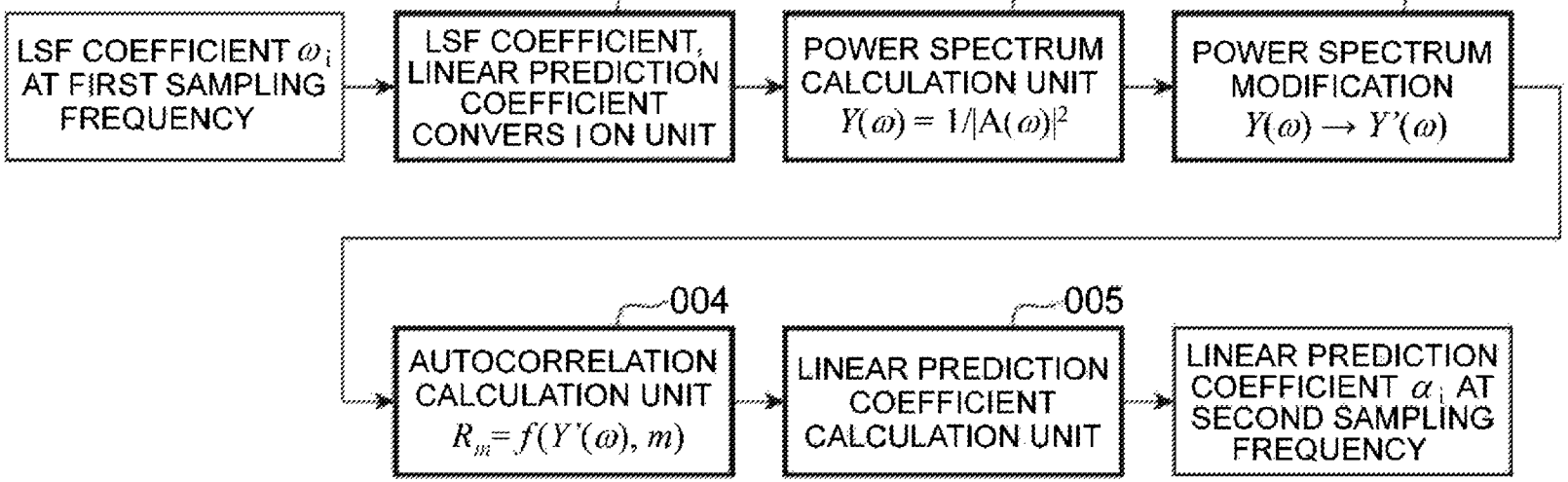
FIG. 2 is a view showing conversion of linear prediction coefficients.

Embodiments of a device, a method and a program are described hereinafter with reference to the drawings. Note that, in the description of the drawings, the same elements are denoted by the same reference symbols and redundant description thereof is omitted.

First, definitions required to describe embodiments are described hereinafter.

A response of an Nth order autoregressive linear prediction filter (which is referred to hereinafter as a linear prediction synthesis filter)

$$\frac{1}{A(z)} = \frac{1}{1 + a_1 z^{-1} + \ldots + a_n z^{-n}} \tag{1}$$

can be adapted to the power spectrum Y(ω) by calculating autocorrelation $$R_k = \frac{1}{2\pi}\int_{-\pi}^{\pi} Y(\omega)\cos k\omega d\omega,\ k = 0, 1, \ldots, n \tag{2}$$

for a known power spectrum Y(ω) at an angular frequency $\omega \in [-\pi, \pi]$ and, using the Nth order autocorrelation coefficients, solving linear prediction coefficients $a_1, a_2, \ldots, a_n$ by the Levinson-Durbin method as a typical method, for example.

Such generation of an autoregressive model using a known power spectrum can be used also for modification of a linear prediction synthesis filter 1/A(z) in the frequency domain. This is achieved by calculating the power spectrum of a known filter $$Y(\omega)=1/|A(\omega)|^2 \tag{3}$$

and modifying the obtained power spectrum Y(ω) by an appropriate method that is suitable for the purpose to obtain the modified power spectrum Y'(ω), then calculating the autocorrelation coefficients of Y'(ω) by the above equation (2), and obtaining the linear prediction coefficients of the modified filter 1/A'(z) by the Levinson-Durbin algorithm or a similar method.

While the equation (2) cannot be analytically calculated except for simple cases, the rectangle approximation can be used as follows, for example.

$$R_k \approx \frac{1}{M}\sum_{\varphi\in\Omega} Y(\varphi)\cos k\varphi \tag{4}$$

where Ω indicates the M number of frequencies placed at regular intervals at the angular frequency [−π,π]. When the symmetric property of Y(−ω)=−Y(ω) is used, the above-mentioned addition only needs to evaluate the angular frequency ω∈[0, π], which corresponds to the upper half of the unit circle. Thus, it is preferred in terms of the amount of computation that the rectangle approximation represented by the above equation (4) is altered as follows $$R_k \approx \frac{1}{N}\left(Y(0) + (-1)^k Y(\pi) + 2\sum_{\varphi\in\Omega_+} Y(\varphi)\cos k\varphi\right) \tag{5}$$

where Ω indicates the (N−2) number of frequencies placed at regular intervals at (0, π), excluding 0 and π.

Hereinafter, line spectral frequencies (which are referred to hereinafter as LSF) as an equivalent means of expression of linear prediction coefficients are described hereinafter.

The representation by LSF is used in various speech and audio coding techniques for the feature quantity of a linear prediction synthesis filter, and the operation and coding of a linear prediction synthesis filter. The LSF uniquely characterizes the Nth order polynomial A(z) by the n number of parameters which are different from linear prediction coefficients. The LSF has characteristics such as it easily guarantee the stability of a linear prediction synthesis filter, it is intuitively interpreted in the frequency domain, it is less likely to be affected by quantization errors than other parameters such as linear prediction coefficients and reflection coefficients, it is suitable for interpolation and the like.

For the purpose of one embodiment of the present invention, LSF is defined as follows.

LSF decomposition of the Nth order polynomial A(z) can be represented as follows by using displacement of an integer where κ≥0

$$A(z)=\{P(z)+Q(z)\}/2 \tag{6}$$

where $P(z)=A(z)+z^{-n-\kappa}A(z^{-1})$ and $$Q(z)=A(z)-z^{-n-\kappa}A(z^{-1})$$

The equation (6) indicates that P(z) is symmetric and Q(z) is antisymmetric as follows $$P(z)=z^{-n-\kappa}P(z^{-1})$$

$$Q(z)=-z^{-n-\kappa}Q(z^{-1})$$

Such symmetric property is an important characteristic in LSF decomposition.

It is obvious that P(z) and Q(z) each have a root at z=±1. Those obvious roots are as shown in the table 1 as n and κ. Thus, polynomials representing the obvious roots of P(z) and Q(z) are defined as $P_T(z)$ and $Q_T(z)$, respectively. When P(z) does not have an obvious root, $P_T(z)$ is 1. The same applies to Q(z).

LSF of A(z) is a non-trivial root of the positive phase angle of P(z) and Q(z). When the polynomial A(z) is the minimum phase, that is, when all roots of A(z) are inside the unit circle, the non-trivial roots of P(z) and Q(z) are arranged alternately on the unit circle. The number of complex roots of P(z) and Q(z) is $m_P$ and $m_Q$, respectively. Table 1 shows the relationship of $m_P$ and $m_Q$ with the order n and displacement κ.

When the complex roots of P(z), which is the positive phase angle, are represented as $$\omega_0, \omega_2, \ldots, \omega_{2m_P-2}$$

and the roots of Q(z) are represented as $$\omega_1, \omega_3, \ldots, \omega_{2m_Q-1},$$

the positions of the roots of the polynomial A(z), which is the minimum phase, can be represented as follows.

$$0<\omega_0<\omega_1<\ldots<\omega_{m_P+m_Q-1}<\pi \tag{7}$$

In speech and audio coding, displacement κ=0 or κ=1 is used. When κ=0, it is generally called immitance spectral frequency (ISF), and when κ=1, it is generally called LSF in a narrower sense than that in the description of one embodiment of the present invention. Note that, however, the representation using displacement can handle both of ISF and LSF in a unified way. In many cases, a result obtained by LSF can be applied as it is to given κ≥0 or can be generalized.

When κ=0, the LSF representation only has the ($m_P+m_Q=n-1$) number of frequency parameters as shown in Table 1. Thus, one more parameter is required to uniquely represent A(z), and the n-th reflection coefficient (which is referred to hereinafter as $\gamma_n$) of A(z) is typically used. This parameter is introduced into LSF decomposition as the next factor.

$$\upsilon=-(\gamma_n+1)/(\gamma_n-1) \tag{8}$$

where $\gamma_n$ is the n-th reflection coefficient of A(z) which begins with Q(z), and it is typically $\gamma_n=a_n$.

When κ=1, the ($m_P+m_Q=n$) number of parameters are obtained by LSF decomposition, and it is possible to uniquely represent A(z). In this case, υ=1.

TABLE 1

| Case | n | κ | $m_P$ | $M_Q$ | $P_r$ (z) | $Q_r$ (z) | ν |
|---|---|---|---|---|---|---|---|
| (1) | even | 0 | n/2 | n/2 − 1 | 1 | $z^2-1$ | −(γ_n + 1)/(γ_n − 1) |
| (2) | odd | 0 | (n − 1)/2 | (n − 1)/2 | z + 1 | z − 1 | −(γ_n + 1)/(γ_n − 1) |
| (3) | even | 1 | n/2 | n/2 | z + 1 | z − 1 | 1 |
| (4) | odd | 1 | (n + 1)/2 | (n − 1)/2 | 1 | $z^2-1$ | 1 |

In consideration of the fact that non-obvious roots, excluding obvious roots, are a pair of complex numbers on the unit circle and obtain symmetric polynomials, the following equation is obtained.

$$\begin{aligned} P(z)/P_T(z) &= 1 + p_1 z^{-1} + p_2 z^{-2} + \ldots + p_2 z^{-2m_P+2} + \\ &\quad p_1 z^{-2m_P+1} + z^{-2m_P} \\ &= (1 + z^{-2m_P}) + p_1(z^{-1} + z^{-2m_P+1}) + \ldots + p_{m_P} z^{-m_P} \\ &= z^{-m_P}((z^{m_P} + z^{-m_P}) + p_1(z^{-m_P-1} + z^{-m_P+1}) + \ldots + p_{m_P}) \end{aligned} \tag{9}$$

Likewise, $$\begin{aligned} Q(z)/\upsilon Q_T(z) &= z^{-m_Q}((z^{m_Q} - z^{-m_Q}) + \\ &\quad q_1(z^{m_Q-1} - z^{-m_Q+1}) + \ldots + q_{m_Q}) \end{aligned} \tag{10}$$

In those polynomials, $$p_1, p_2, \ldots, p_{m_P}$$

and $$q_1, q_2, \ldots, q_{m_Q}$$

completely represent P(z) and Q(z) by using given displacement κ and ν that is determined by the order n of A(z). Those coefficients can be directly obtained from the expressions (6) and (8).

When $z=e^{j\omega}$ and using the following relationship $$z^k+z^{-k}=e^{j\omega k}+e^{-j\omega k}=2\cos\omega k$$

the expressions (9) and (10) can be represented as follows $$P(\omega)=2e^{-j\omega m_P}R(\omega)P_T(\omega) \tag{11}$$

$$Q(\omega)=2e^{-j\omega m_Q}\upsilon S(\omega)Q_T(\omega) \tag{12}$$

where $$R(\omega)=\cos m_P\omega+p_1\cos(m_P-1)\omega+\ldots+p_{m_P}/2 \tag{13}$$

and $$S(\omega)=\cos m_Q\omega+q_1\cos(m_Q-1)\omega+\ldots+q_{m_Q}/2 \tag{14}$$

Specifically, LSF of the polynomial A(z) is the roots of R(ω) and S(ω) at the angular frequency $\omega\in(0, \pi)$.

The Chebyshev polynomials of the first kind, which is used in one embodiment of the present invention, is described hereinafter.

The Chebyshev polynomials of the first kind is defined as follows using a recurrence relation $$T_{k+1}(x)=2xT_k(x)-T_{k-1}(x)\quad k=1, 2, \ldots \tag{15}$$

Note that the initial values are $T_0(x)=1$ and $T_1(x)=x$, respectively. For x where [−1, 1], the Chebyshev polynomials can be represented as follows $$T_k(x)=\cos\{k\cos^{-1}x\}k=0, 1, \ldots \tag{16}$$

One embodiment of the present invention explains that the equation (15) provides a simple method for calculating cos kω (where k=2, 3, . . . ) that begins with cos ω and cos 0=1. Specifically, with use of the equation (16), the equation (15) is rewritten in the following form $$\cos k\omega=2\cos\omega\cos(k-1)\omega-\cos(k-2)\omega\quad k=2, 3, \ldots \tag{17}$$

When conversion ω=arc cos x is used, the first polynomials obtained from the equation (15) are as follows $$\begin{cases} T_2(x)=2x^2-1 \\ T_3(x)=4x^3-3x \\ T_4(x)=8x^4-8x^2+1 \\ T_5(x)=16x^5-20x^3+5x \\ T_6(x)=32x^6-48x^4+18x^2-1 \\ T_7(x)=64x^7-112x^5+56x^3-7x \\ T_8(x)=128x^8-256x^6+160x^4-32x^2+1 \end{cases}$$

When the equations (13) and (14) for $x\in[-1,1]$ are replaced by those Chebyshev polynomials, the following equations are obtained $$R(x)=T_{m_P}(x)+p_1T_{m_{P-1}}(x)+\ldots+p_{m_P}/2 \tag{18}$$

$$S(x)=T_{m_Q}(x)+q_1T_{m_{Q-1}}(x)+\ldots+q_{m_Q}/2 \tag{19}$$

When LSF$\omega_i$ is known for i=0, 1, . . . , $m_P+m_Q-1$, the following equations are obtained using the cosine of LSF $x_i=\cos\omega_i$ (LSP)

$$R(x)=r_0(x-x_0)(x-x_2)\ldots(x-x_{2m_P-2}) \tag{20}$$

$$S(x)=s_0(x-x_1)(x-x_3)\ldots(x-x_{2m_Q-1}) \tag{21}$$

The coefficients $r_0$ and $s_0$ can be obtained by comparison of the equations (18) and (19) with (20) and (21) on the basis of $m_P$ and $m_Q$.

The equations (20) and (21) are written as $$R(x)=r_0x^{m_P}+r_1x^{m_P-1}+\ldots+r_{m_P} \tag{22}$$

$$S(x)=s_0x^{m_Q}+s_1x^{m_Q-1}+\ldots+s_{m_Q} \tag{23}$$

Those polynomials can be efficiently calculated for a given x by a method known as the Horner's method. The Horner's method obtains $R(x)=b_0(x)$ by use of the following recursive relation $$b_k(x)=xb_{k+1}(x)+r_k$$

where the initial value is $$b_{m_P}(x)=r_{m_P}$$

The same applies to S(x).

A method of calculating the coefficients of the polynomials of the equations (22) and (23) is described hereinafter using an example. It is assumed in this example that the order of A(z) is 16 (n=16). Accordingly, $m_P=m_Q=8$ in this case. Series expansion of the equation (18) can be represented in the form of the equation (22) by substitution and simplification by the Chebyshev polynomials. As a result, the coefficients of the polynomial of the equation (22) are represented as follows using the coefficient $p_i$ of the polynomial P(z).

$$\begin{cases} r_0=128 \\ r_1=64p_1 \\ r_2=-256+32p_2 \\ r_3=-118p_1+16p_3 \\ r_4=160-48p_2+8p_4 \\ r_5=56p_1-20p_3+4p_5 \\ r_6=-32+18p_2-8p_4+2p_6 \\ r_7=-7p_1+5p_3-3p_5+p_7 \\ r_8=1-p_2+p_4-p_6+p_8/2 \end{cases}$$

The coefficients of P(z) can be obtained from the equation (6). This example can be applied also to the polynomial of the equation (23) by using the same equation and using the coefficients of Q(z). Further, the same equation for calculating the coefficients of R(x) and S(x) can easily derive another order n and displacement κ as well.

Further, when the roots of the equations (20) and (21) are known, coefficients can be obtained from the equations (20) and (21).

The outline of processing according to one embodiment of the present invention is described hereinafter.

One embodiment of the present invention provides an effective calculation method and device for, when converting a linear prediction synthesis filter calculated in advance by an encoder or a decoder at a first sampling frequency to the one at a second sampling frequency, calculating the power spectrum of the linear prediction synthesis filter and modifying it to the second sampling frequency, and then obtaining autocorrelation coefficients from the modified power spectrum.

A calculation method for the power spectrum of a linear prediction synthesis filter according to one embodiment of the present invention is described hereinafter. The calculation of the power spectrum uses the LSF decomposition of the equation (6) and the properties of the polynomials P(z) and Q(z). By using the LSF decomposition and the above-described Chebyshev polynomials, the power spectrum can be converted to the real axis of the unit circle.

With the conversion to the real axis, it is possible to achieve an effective method for calculating a power spectrum at an arbitrary frequency in $\omega \in [0, \pi]$. This is because it is possible to eliminate transcendental functions since the power spectrum is represented by polynomials. Particularly, it is possible to simplify the calculation of the power spectrum at $\omega=0$, $\omega=\pi/2$ and $\omega=\pi$. The same simplification is applicable also to LSF where either one of P(z) or Q(z) is zero. Such properties are advantageous compared with FFT, which is generally used for the calculation of the power spectrum.

It is known that the power spectrum of A(z) can be represented as follows using LSF decomposition.

$$|A(\omega)|^2=\{|P(\omega)|^2+|Q(\omega)|^2\}/4 \tag{26}$$

One embodiment of the present invention uses the Chebyshev polynomials as a way to more effectively calculate the power spectrum $|A(\omega)|^2$ of A(z) compared with the case of directly applying the equation (26). Specifically, the power spectrum $|A(\omega)|^2$ is calculated on the real axis of the unit circle as represented by the following equation, by converting a variable to $x=\cos\omega$ and using LSF decomposition by the Chebyshev polynomials.

$$|A(x)|^2 = \{|P(x)|^2 + |Q(x)|^2\}/4 = \begin{cases} R^2(x) + 4\upsilon^2(1-x^2)S^2(x), & \text{Case (1)(4)} \\ 2(1+x)R^2(x) + 2\upsilon^2(1-x)S^2(x), & \text{Case (2)(3)} \end{cases} \tag{27}$$

(1) to (4) correspond to (1) to (4) in Table 1, respectively.

The equation (27) is proven as follows.

The following equations are obtained from the equations (11) and (12).

$$|P(\omega)|^2=4|R(\omega)|^2|P_T(\omega)|^2$$

$$|Q(\omega)|^2=4\upsilon^2|S(\omega)|^2|Q_T(\omega)|^2$$

The factors that represent the obvious roots of $P(\omega)$ and $Q(\omega)$ are respectively as follows.

$$|P_T(\omega)|^2 = \begin{cases} 1, & \text{Case (1)(4)} \\ |1+e^{-j\omega}|^2 = 2+2\cos\omega, & \text{Case (2)(3)} \end{cases}$$

$$|Q_T(\omega)|^2 = \begin{cases} |1-e^{-2j\omega}|^2 = 2-2\cos 2\omega, & \text{Case (1)(4)} \\ |1-e^{-j\omega}|^2 = 2-2\cos\omega, & \text{Case (2)(3)} \end{cases}$$

Application of the substitution $\cos\omega=x$ and $\cos 2\omega=2x^2-1$ to $|P_T(\omega)|$ and $|Q_T(\omega)|$, respectively, gives the equation (27).

The polynomials R(x) and S(x) may be calculated by the above-described Horner's method. Further, when x to calculate R(x) and S(x) is known, the calculation of a trigonometric function can be omitted by storing x in a memory.

The calculation of the power spectrum of A(z) can be further simplified. First, in the case of calculating with LSF, one of R(x) and S(x) in the corresponding equation (27) is zero. When the displacement is $\kappa=1$ and the order n is an even number, the equation (27) is simplified as follows.

$$|A(x_i)|^2 = \begin{cases} 2(1-x_i)S^2(x_i), & i \text{ even} \\ 2(1+x_i)R^2(x_i) & i \text{ odd} \end{cases}$$

Further, in the case of $\omega=\{0,\pi/2,\pi\}$, it is simplified when $x=\{1,0,-1\}$. The equations are as follows when the displacement is $\kappa=1$ and the order n is an even number, which are the same as in the above example.

$$|A(\omega=0)|^2=4R^2(1)$$

$$|A(\omega=\pi/2)|^2=2(R^2(0)+S^2(0))$$

$$|A(\omega=\pi)|^2=4S^2(-1)$$

The similar results can be easily obtained also when the displacement is $\kappa=0$ and the order n is an odd number.

The calculation of autocorrelation coefficients according to one embodiment of the present invention is described below.

In the equation (5), when a frequency $\Omega_+=\Delta, 2\Delta, \ldots, (N-1)\Delta$ where N is an odd number and the interval of frequencies is $\Delta=\pi/(N-1)$ is defined, the calculation of autocorrelation contains the above-described simplified power spectrum at $\omega=0,\pi/2,\pi$. Because the normalization of autocorrelation coefficients by 1/N does not affect linear prediction coefficients to be obtained as a result, any positive value can be used.

Still, however, the calculation of the equation (5) requires $\cos k\omega$ where $k=1, 2, \ldots, n$ for each of the (N−2) number of frequencies. Thus, the symmetric property of $\cos k\omega$ is used.

$$\cos(\pi-k\omega)=(-1)^k \cos k\omega,\ \omega\in(0, \pi/2) \tag{28}$$

The following characteristics are also used.

$$\cos(k\pi/2)=(1/2)(1+(-1)^{k+1})(-1)^{\lfloor k/2\rfloor} \tag{29}$$

where $\lfloor x\rfloor$ indicates the largest integer that does not exceed x. Note that the equation (29) is simplified to 2, 0, −2, 0, 2, 0, . . . for k=0, 1, 2, . . . .

Further, by conversion to $x=\cos\omega$, the autocorrelation coefficients are moved onto the real axis of the unit circle. For this purpose, the variable $X(x)=Y(\arccos x)$ is introduced. This enables the calculation of $\cos k\omega$ by use of the equation (15).

Figure 6:
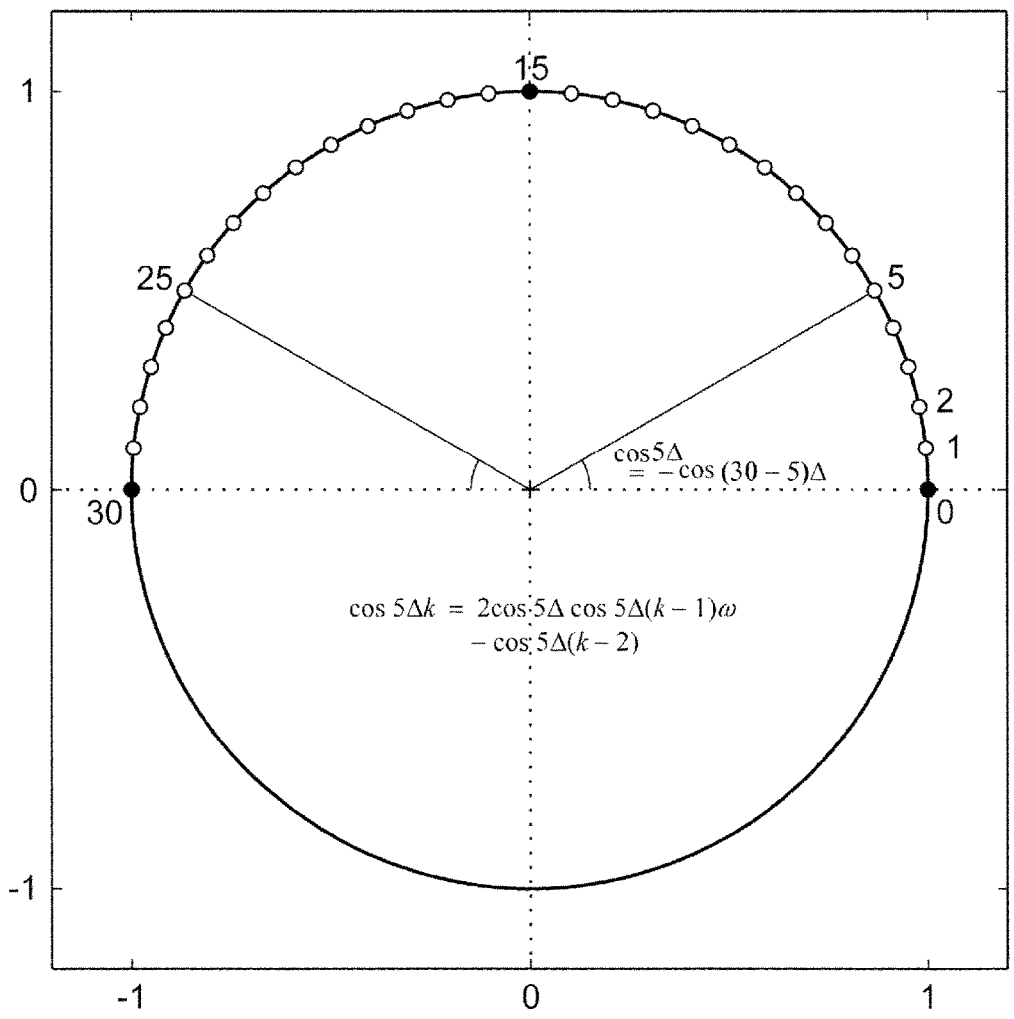
FIG. 6 is a view showing the relationship between a unit circle and a cosine function.

Given the above, the autocorrelation approximation of the equation (5) can be replaced by the following equation.

$$R'_k = X(1) + (-1)^k X(-1) + (1+(-1)^{k+1})(-1)^{\lfloor k/2\rfloor} X(0) + 2\sum_{x\in\Lambda}(X(x)+(-1)^k X(-x))T_k(x) \tag{30}$$

where $T_k(x)=2xT_{k-1}(x)-T_{k-2}(x)$ $k=2, 3, \ldots, n$, and $T_0(x)=1$, $T_1(x)=\cos x$ as described above. When the symmetric property of the equation (28) is taken into consideration, the last term of the equation (30) needs to be calculated only when $x\in\Lambda=\{\cos\Delta, \cos 2\Delta, \ldots, (N-3)\Delta/2\}$, and the (N−3)/2 number of cosine values can be stored in a memory. FIG. 6 shows the relationship between the frequency $\Lambda$ and the cosine function when N=31.

An example of the present invention is described hereinafter. In this example, a case of converting a linear prediction synthesis filter calculated at a first sampling frequency of 16,000 Hz to that at a second sampling frequency of 12,800 Hz (which is referred to hereinafter as conversion 1) and a case of converting a linear prediction synthesis filter calculated at a first sampling frequency of 12,800 Hz to that at a second sampling frequency of 16,000 Hz (hereinafter as conversion 2) are used. Those two sampling frequencies have a ratio of 4:5 and are generally used in speech and audio coding. Each of the conversion 1 and the conversion 2 of this example is performed on the linear prediction synthesis filter in the previous frame when the internal sampling frequency has changed, and it can be performed in any of an encoder and a decoder. Such conversion is required for setting the correct internal state to the linear prediction synthesis filter in the current frame and for performing interpolation of the linear prediction synthesis filter in accordance with time.

Figure 3:
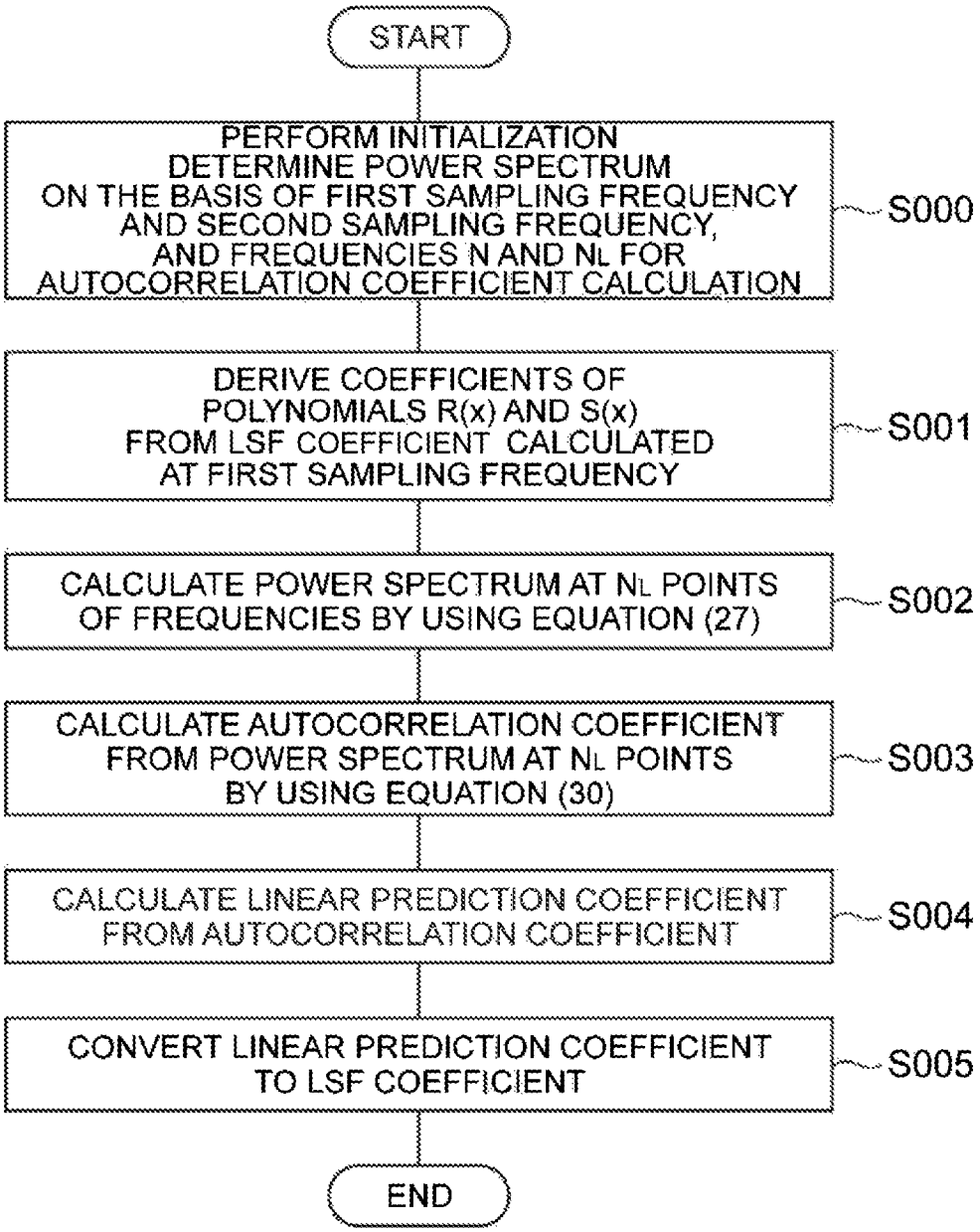
FIG. 3 is a flowchart of conversion 1.
Figure 4:
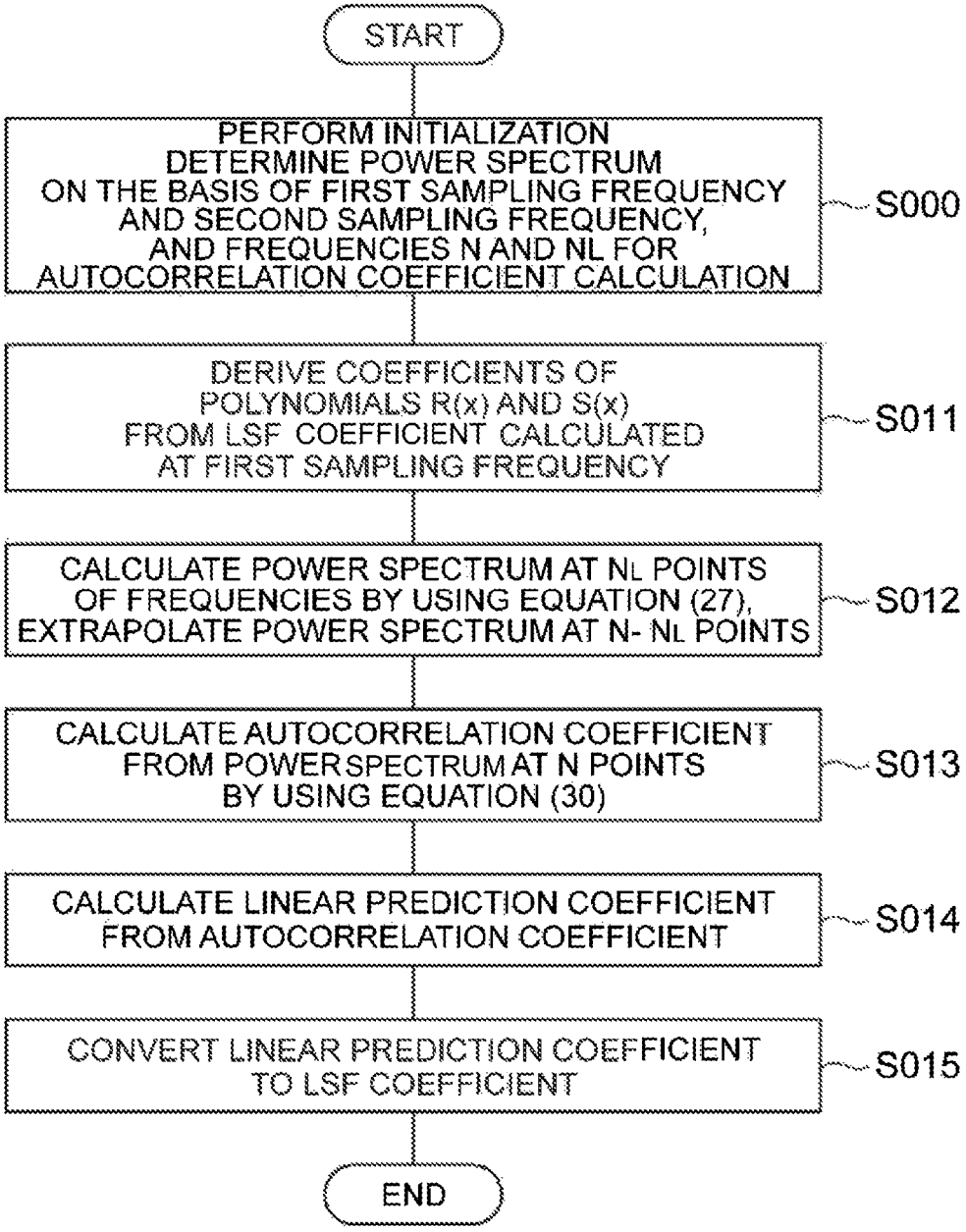
FIG. 4 is a flowchart of conversion 2.

Processing in this example is described hereinafter with reference to the flowcharts of FIGS. 3 and 4.

To calculate a power spectrum and autocorrelation coefficients by using a common frequency point in both cases of the conversions 1 and 2, the number of frequencies when a sampling frequency is 12,800 Hz is determined as $N_L=1+(12{,}800\text{ Hz}/16{,}000\text{ Hz})(N-1)$. Note that N is the number of frequencies at a sampling frequency of 16,000 Hz. As described earlier, it is preferred that N and $N_L$ are both odd numbers in order to contain frequencies at which the calculation of a power spectrum and autocorrelation coefficients is simplified. For example, when N is 31, 41, 51, 61, the corresponding $N_L$ is 25, 33, 41, 49. The case where N=31 and $N_L$=25 is described as an example below (Step S000).

When the number of frequencies to be used for the calculation of a power spectrum and autocorrelation coefficients in the domain where the sampling frequency is 16,000 Hz is N=31, the interval of frequencies is $\Delta=\pi/30$, and the number of elements required for the calculation of autocorrelation contained in $\Lambda$ is $(N-3)/2=14$.

The conversion 1 that is performed in an encoder and a decoder under the above conditions is carried out in the following procedure.

Determine the coefficients of polynomials R(x) and S(x) by using the equations (20) and (21) from roots obtained by displacement $\kappa=0$ or $\kappa=1$ and LSF which correspond to a linear prediction synthesis filter obtained at a sampling frequency of 16,000 Hz, which is the first sampling frequency (Step S001).

Calculate the power spectrum of the linear prediction synthesis filter at the second sampling frequency up to 6,400 Hz, which is the Nyquist frequency of the second sampling frequency. Because this cutoff frequency corresponds to $\omega=(4/5)\pi$ at the first sampling frequency, a power spectrum is calculated using the equation (27) at $N_L$=25 number of frequencies on the low side. For the calculation of R(x) and S(x), the Horner's method may be used to reduce the calculation. There is no need to calculate a power spectrum for the remaining 6 ($=N-N_L$) frequencies on the high side (Step S002).

Calculate autocorrelation coefficients corresponding to the power spectrum obtained in Step S002 by using the equation (30). In this step, N in the equation (30) is set to $N_L$=25, which is the number of frequencies at the second sampling frequency (Step S003).

Derive linear prediction coefficients by the Levinson-Durbin method or a similar method with use of the autocorrelation coefficient obtained in Step S003, and obtain a linear prediction synthesis filter at the second sampling frequency (Step S004).

Convert the linear prediction coefficient obtained in Step S004 to LSF (Step S005).

The conversion 2 that is performed in an encoder or a decoder can be achieved in the following procedure, in the same manner as the conversion 1.

Determine the coefficients of polynomials R(x) and S(x) by using the equations (20) and (21) from roots obtained by displacement $\kappa=0$ or $\kappa=1$ and LSF which correspond to a linear prediction synthesis filter obtained at a sampling frequency of 12,800 Hz, which is the first sampling frequency (Step S011).

Calculate the power spectrum of the linear prediction synthesis filter at the second sampling frequency up to 6,400 Hz, which is the Nyquist frequency of the first sampling frequency, first. This cutoff frequency corresponds to $\omega=\pi$, and a power spectrum is calculated using the equation (27) at $N_L$=25 number of frequencies. For the calculation of R(x) and S(x), the Horner's method may be used to reduce the calculation. For 6 frequencies exceeding 6,400 Hz at the second sampling frequency, a power spectrum is extrapolated. As an example of extrapolation, the power spectrum obtained at the $N_L$-th frequency may be used (Step S012).

Calculate autocorrelation coefficients corresponding to the power spectrum obtained in Step S012 by using the equation (30). In this step, N in the equation (30) is set to N=31, which is the number of frequencies at the second sampling frequency (Step S013).

Derive linear prediction coefficients by the Levinson-Durbin method or a similar method with use of the autocorrelation coefficient obtained in Step S013, and obtain a linear prediction synthesis filter at the second sampling frequency (Step S014).

Convert the linear prediction coefficient obtained in Step S014 to LSF (Step S015).

Figure 5:
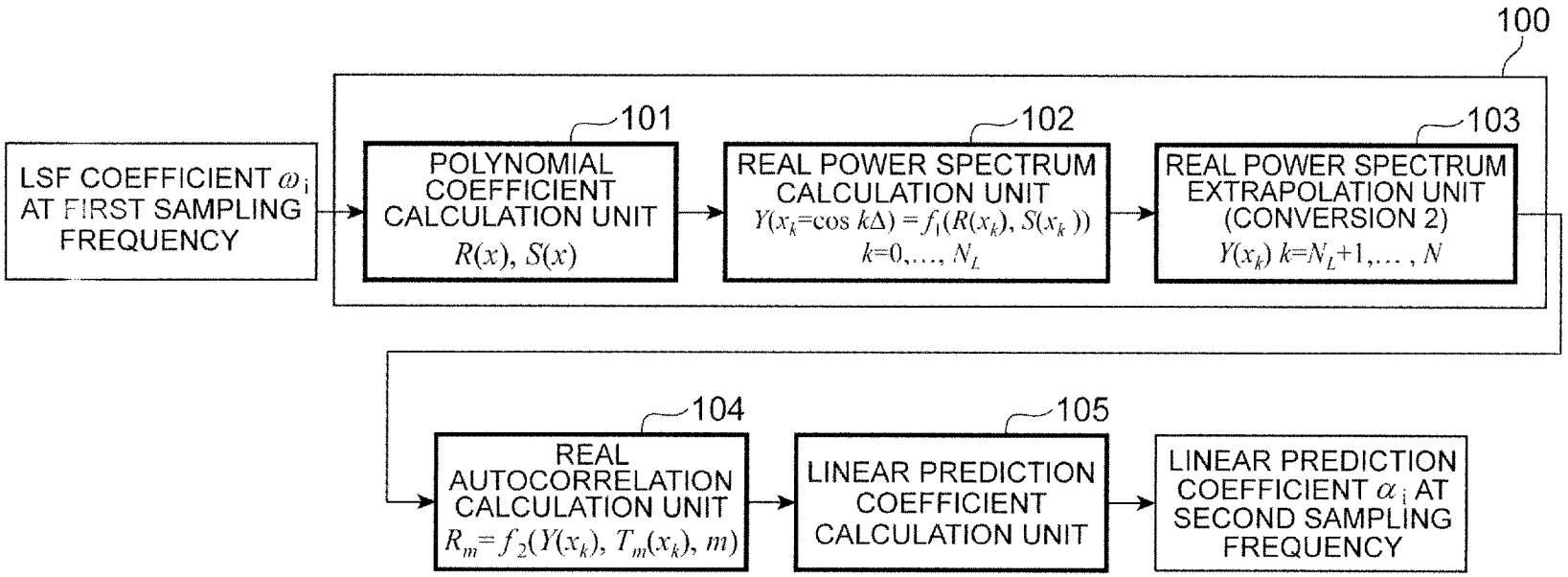
FIG. 5 is a block diagram of an embodiment of the present invention.

FIG. 5 is a block diagram in the example of the present invention. A real power spectrum conversion unit 100 is composed of a polynomial calculation unit 101, a real power spectrum calculation unit 102, and a real power spectrum extrapolation unit 103, and further a real autocorrelation calculation unit 104 and a linear prediction coefficient calculation unit 105 are provided. This is to achieve the above-described conversions 1 and 2. Just like the description of the flowcharts described above, the real power spectrum conversion unit 100 receives, as an input, LSF representing a linear prediction synthesis filter at the first sampling frequency, and outputs the power spectrum of a desired linear prediction synthesis filter at the second sampling frequency. First, the polynomial calculation unit 101 performs the processing in Steps S001, S011 described above to calculate the polynomials R(x) and S(x) from LSF. Next, the real power spectrum calculation unit 102 performs the processing in Steps S002 or S012 to calculate the power spectrum. Further, the real power spectrum extrapolation unit 103 performs extrapolation of the spectrum, which is performed in Step S012 in the case of the conversion 2. By the above process, the power spectrum of a desired linear prediction synthesis filter is obtained at the second sampling frequency. After that, the real autocorrelation calculation unit 104 performs the processing in Steps S003 and S013 to convert the power spectrum to autocorrelation coefficients. Finally, the linear prediction coefficient calculation unit 105 performs the processing in Steps S004 and S014 to obtain linear prediction coefficients from the autocorrelation coefficients. Note that, although this block diagram does not show the block corresponding to S005 and S015, the conversion from the linear prediction coefficients to LSF or another equivalent coefficients can be easily achieved by a known technique.

Alternative Example

Although the coefficients of the polynomials R(x) and S(x) are calculated using the equations (20) and (21) in Steps S001 and S011 of the above-described example, the calculation may be performed using the coefficients of the polynomials of the equations (9) and (10), which can be obtained from the linear prediction coefficients. Further, the linear prediction coefficients may be converted from LSP coefficients or ISP coefficients.

Furthermore, in the case where a power spectrum at the first sampling frequency or the second sampling frequency is known by some method, the power spectrum may be converted to that at the second sampling frequency, and Steps S001, S002, S011 and S012 may be omitted.

In addition, in order to assign weights in the frequency domain, a power spectrum may be deformed, and linear prediction coefficients at the second sampling frequency may be obtained.

What is claimed is:

1. A linear prediction coefficient conversion device comprising circuitry configured to:

determine a first linear prediction synthesis filter at a first sampling frequency, the first linear prediction synthesis filter comprising first linear prediction coefficients associated therewith;

calculate, using line spectrum frequency (LSF) decomposition and Chebyshev polynomials, a power spectrum based on the first linear prediction coefficients;

calculate autocorrelation coefficients from the power spectrum based, at least in part, on a number of frequencies associated with a second sampling frequency, wherein the number of frequencies associated with the second sampling frequency is different than a number of frequencies associated with the first sampling frequency;

generate, based, at least in part, on the autocorrelation coefficients calculated from the power spectrum, a second linear prediction synthesis filter at the second sampling frequency, wherein the second linear prediction synthesis filter comprises second linear prediction coefficients associated therewith; and encode or decode an audio signal by replacement of the first linear prediction synthesis filter with the second linear prediction synthesis filter.

2. The linear prediction coefficient conversion device according to claim 1, wherein the power spectrum is calculated using the first linear prediction coefficients at points on a real axis of a unit circle corresponding to N1 number of different frequencies at the first sampling frequency (F1), where $N1=1+(F1/F2)(N2-1)$, and where there are N2 number of different frequencies at the second sampling frequency (F2) (where $F1<F2$), and the circuitry is further configured to extrapolate the power spectrum calculated using the first linear prediction coefficients to obtain (N2−N1) number of power spectrum components.

3. The linear prediction coefficient conversion device according to claim 1, wherein the power spectrum is calculated using the first linear prediction coefficients at points on a real axis of a unit circle corresponding to N1 number of different frequencies at the first sampling frequency (F1), where $N1=1+(F1/F2)(N2-1)$, and where there are N2 number of different frequencies at the second sampling frequency (F2) (where $F1<F2$).

4. The linear prediction coefficient conversion device according to claim 1, wherein the circuity is configured to calculate both the power spectrum and the autocorrelation coefficients on a real axis of a unit circle.

5. The linear prediction coefficient conversion device according to claim 1, wherein the circuitry is configured to determine the second linear prediction coefficients by:

derivation of linear prediction coefficients from the autocorrelation coefficients; and conversion of the linear prediction coefficients into LSF coefficients.

6. The linear prediction coefficient conversion device according to claim 1, wherein the circuitry is configured to process the audio signal by encoding or decoding a speech signal with the second linear prediction synthesis filter.

7. A linear prediction coefficient conversion determining a first linear prediction synthesis filter at a first sampling frequency, the first linear prediction synthesis filter comprising first linear prediction coefficients associated therewith;

calculating, using line spectrum frequency (LSF) decomposition and Chebyshev polynomials, a power spectrum based on the first linear prediction coefficients;

calculating autocorrelation coefficients from the power spectrum based, at least in part, on a number of frequencies associated with a second sampling frequency, wherein the number of frequencies associated with the second sampling frequency is different than a number of frequencies associated with the first sampling frequency;

generating a second linear prediction synthesis filter at the second sampling frequency based, at least in part, on the autocorrelation coefficients calculated from the power spectrum, wherein the second linear prediction synthesis filter comprises second linear prediction coefficients are associated therewith; and encoding or decoding an audio signal in conjunction with replacing the first linear prediction filter with the second linear prediction filter.

8. The linear prediction coefficient conversion method according to claim 7, wherein the power spectrum is calculated using the first linear prediction coefficients at points on a real axis of a unit circle corresponding to N1 number of different frequencies at the first sampling frequency (F1), where $N1=1+(F1/F2)(N2-1)$, and where there are N2 number of different frequencies at the second sampling frequency (F2) (where $F1<F2$), and extrapolating the power spectrum calculated using the first linear prediction coefficients for obtaining (N2−N1) number of power spectrum components.

9. The linear prediction coefficient conversion method according to claim 7, wherein the power spectrum is calculated using the first linear prediction coefficients at points on a real axis of a unit circle corresponding to N1 number of different frequencies at the first sampling frequency (F1), where $N1=1+(F1/F2)(N2-1)$, and where there are N2 number of different frequencies at the second sampling frequency is (F2) (where $F1<F2$).

10. The linear prediction coefficient conversion method according to claim 7, wherein the power spectrum and the autocorrelation coefficients are both calculated on a real axis of a unit circle.

11. The linear prediction coefficient conversion method according to claim 7, further comprising converting the second linear prediction coefficients into LSF coefficients.

12. The linear prediction coefficient conversion method according to claim 7, wherein processing the audio signal comprises encoding the audio signal using the second linear prediction synthesis filter.

13. The linear prediction coefficient conversion method according to claim 7, wherein processing the audio signal comprises decoding the audio signal using the second linear prediction synthesis filter.

* * * * *